US007803237B2

(12) United States Patent
Cokain et al.

(10) Patent No.: US 7,803,237 B2
(45) Date of Patent: Sep. 28, 2010

(54) NICKEL-BASE ALLOY AND ARTICLES MADE THEREFROM

(75) Inventors: Thomas W. Cokain, Hermitage, PA (US); Behram M. Kapadia, Sewickley, PA (US); Charles J. Stein, McKeesport, PA (US)

(73) Assignee: Damascus Steel Casting Company, New Brighton, PA (US)

( * ) Notice: Subject to any disclaimer, the term of this patent is extended or adjusted under 35 U.S.C. 154(b) by 405 days.

(21) Appl. No.: 11/185,249

(22) Filed: Jul. 20, 2005

(65) Prior Publication Data

US 2007/0020137 A1 Jan. 25, 2007

(51) Int. Cl.
*C22C 19/05* (2006.01)

(52) U.S. Cl. ..... 148/428; 420/445

(58) Field of Classification Search ..... 148/426–429
See application file for complete search history.

(56) References Cited

U.S. PATENT DOCUMENTS

| | | | | |
|---|---|---|---|---|
| 3,403,998 | A | 10/1968 | Martin et al. | |
| 3,962,897 | A | 6/1976 | Way et al. | |
| 4,006,015 | A * | 2/1977 | Watanabe et al. | 420/451 |
| 4,034,588 | A | 7/1977 | Way et al. | |
| 4,078,412 | A | 3/1978 | Way et al. | |
| 4,227,925 | A | 10/1980 | Hosoi et al. | |
| 4,348,241 | A | 9/1982 | Kunioka et al. | |
| 4,421,571 | A * | 12/1983 | Kudo et al. | 148/501 |
| 4,464,210 | A * | 8/1984 | Watanabe | 148/675 |
| 4,476,091 | A | 10/1984 | Klarstrom et al. | |
| 4,727,740 | A | 3/1988 | Yabuki et al. | |
| 2007/0158934 | A1 * | 7/2007 | Lee et al. | 280/737 |
| 2007/0181225 | A1 * | 8/2007 | Igarashi et al. | 148/410 |

FOREIGN PATENT DOCUMENTS

| | | |
|---|---|---|
| FR | 1 287 914 | 3/1962 |
| FR | 1 287 914 A | 3/1962 |

(Continued)

OTHER PUBLICATIONS

H.M. Tawancy, High Temperature Oxidation Behavior of a Wrought Ni—Cr—W—Mn—Si—La alloy, Oxidation of Metals, vol. 45, Nos. 3,4, 1996, p. 323-348.*

(Continued)

*Primary Examiner*—George Wyszomierski
*Assistant Examiner*—Mark L Shevin
(74) *Attorney, Agent, or Firm*—K&L Gates LLP

(57) ABSTRACT

A wear and oxidation resistant nickel-base alloy, exhibiting resistance to thermal cracking in high-stress elevated temperature environments, comprises, in weight percentages based on total alloy weight: 53 to 67 nickel; 20 to 26 chromium; and 12 to 18 tungsten. The alloy optionally further comprises, in weight percentages based on total alloy weight, at least one of: up to 3 cobalt; up to 3 molybdenum; up to 6 iron; 0.1 to 0.5 manganese; 0.1 to 0.7 silicon; 0.1 to 0.6 aluminum; and less than 0.05 carbon. Components of a seamless tube manufacturing apparatus fabricated from the alloy also are provided. The components may be, for example, tools for one of a piercing mill, a high mill, and a rotary expander, such as piercer points, piercing mill guide shoes, rotary expander guide shoes, reeler guide shoes, and high-mill plugs.

11 Claims, 2 Drawing Sheets

FOREIGN PATENT DOCUMENTS

| | | | |
|---|---|---|---|
| JP | 60 024297 A | | 2/1985 |
| JP | 02-153035 | * | 6/1990 |
| JP | 07 268552 A | | 10/1995 |

OTHER PUBLICATIONS

Haynes® 230® Technical Brief (Jan. 2003).*
T. Matsuo et al. Strengthening of nickel-base superalloys for nuclear heat exchanger applications. Journal of Materials Science 22 (1987) p. 1901-1907.*
Haynes 230W Alloy—STN Indexing for Registry No. 205674-48-2, Published May 20, 1998, one page.*
Alloy KhN60—STN Indexing for Registry No. 12793-38-3, Published Nov. 16, 1984, one page.*
English translation of JP 02-153035 to Okada, published Jun. 12, 1990, 23 pages.*
McLaren, M.C., "The Two Roll Barrel Type Piercing Mill: Theory, Design and Operation" (Timken Roller Bearing Company, 1965), pp. 2-28.

* cited by examiner

NICKEL-BASE ALLOY AND ARTICLES MADE THEREFROM

BACKGROUND OF THE TECHNOLOGY

1. Field of Technology

The present disclosure relates to nickel-base alloys and articles fabricated from and including such alloys. More particularly, the present disclosure relates to nickel-base alloys having high strength and substantial resistance to wear, oxidation, and thermal cracking in certain high-stress elevated temperature environments.

2. Description of the Background of the Technology

The manufacture of seamless steel tube and pipe using piercer points, pipe plugs, and reeler plugs is well known. A generally cylindrical steel bar or billet is heated to a temperature in the range of about 2000° F. to about 2300° F. (about 1093° C. to about 1260° C.) and then processed on a specialized hot forming apparatus such as, for example, a Mannesmann piercing mill. The apparatus typically includes: a pair of generally barrel-shaped, tapered upper and lower rolls disposed in skewed relation to one other; a set of opposed guide shoes disposed on opposite sides of central axes of the tapered rolls; and a generally spearhead-shaped plug, commonly referred to as a "piercer point", mounted on the end of a mandrel and positioned intermediate and in front of the gorge of the barrel-shaped rolls. The rolls are driven to rotate. As the hot cylindrical-shaped billet is brought into contact with the rotating rolls, the billet spins and axially advances over the piercer point. As the piercer point pierces the billet axially, the billet material flows around the piercer point, and a hollow tube or shell results. The guide shoes are arranged 90 degrees circumferentially of each of the barrel-shaped rolls, and in an opposed relation to one another. As the shell is produced, it slidingly contacts the opposed guide shoes, which control the outer shape and thickness of the shell wall. The hollow shell is then typically reworked in a high mill or other elongator, such as a mandrel mill, Transval mill, or Assel mill, by rolling or drawing over a stationary mandrel, known as a "hi mill plug", to provide a tube or pipe having the desired wall thickness and outer diameter.

A piercer point is subjected to very high stresses and temperatures during the piercing operation. After each piercing run, the piercer point is typically rapidly cooled by passing a stream of air or mist over the piercer point, or by quenching the piercer point in water. In certain seamless pipe manufacturing apparatus, the piercer point is internally cooled during the piercing operation, such as by circulating water within the piercer point. The purpose of reducing the temperature of the piercer point is to better maintain its physical integrity during successive piercing runs. However, the combination of the piercing conditions and the associated cooling practice subjects the piercer point to very high compressive and torsional stresses under conditions of extreme thermal shock, impact, and wear. Thus, the piercer point rather quickly wears and must be replaced regularly, which necessitates additional costs and apparatus downtime. Improving the resistance of piercer points to the extreme conditions to which they are subjected would increase the service life of the parts, improve throughput on the forming apparatus, and thereby reduce per unit cost of the fabricated seamless products.

Piercer points fabricated from several conventional alloys are prone to significant and unacceptable distortion (loss of original shape) caused by deformation and/or wear during the piercing operation. These conventional alloys also are prone to develop significant thermal fatigue cracking during piercing and/or cool down. Thermal cracking can lead to fragmentation and loss of material from the piercer point, which can result in the need for frequent piercer point replacement and unsatisfactory inner diameter surface quality in the seamless product.

Table 1 lists several conventional alloy compositions from which piercer points have been fabricated. In Table 1, and throughout the present disclosure, alloy compositions are provided as weight percentages based on total alloy weight. Alloy A, which is sometimes referred to in the trade as "Coloy", is a high-cobalt alloy including significant levels of nickel and chromium. Alloy B, commonly designated as "Hastelloy C modified", is a nickel-base alloy principally including molybdenum and chromium as alloying additions. Alloy C, which is known as "Inco NX-188", also is a nickel-base alloy, including molybdenum and aluminum. The compositions of Alloys D and E, commonly referred to as "E-1" and "E-15", respectively, are essentially low-carbon, low-alloy steels, and are typically used in less demanding piercing applications. In addition to what is listed in Table 1, Alloy E also includes 1.00 to 1.25 copper. The elements included in Table 1 and other tables herein without reported levels may be present in the alloys only in residual amounts.

TABLE 1

Conventional Alloy Compositions for Piercer Points

| Alloy | Ni | Co | Cr | Mo | W | Fe | Mn | Si | Al | C |
|---|---|---|---|---|---|---|---|---|---|---|
| A | 10.0-12.0 | Bal. | 18.0-22.0 | 1.0 max. | 13.0-17.0 | 8.0 max. | 2.0 max. | 0.70 max. | — | 0.12 max. |
| B | Bal. | — | 14.0-18.0 | 15.0-19.0 | 3.0-5.0 | 5.0 max. | 0.5 max. | 0.5 max. | — | 0.02 max. |
| C | Bal. | — | — | 16.0-20.0 | — | — | — | — | 7.0-9.0 | 0.1 max. |
| D | 2.00-2.20 | — | 1.20-1.50 | — | — | Bal. | 0.55-0.70 | 0.20 max. | — | 0.20-0.30 |
| E | 0.50-0.90 | 1.20-1.30 | 1.50-1.75 | 0.08-0.13 | — | Bal. | 0.50 max. | 0.50 max. | — | 0.15-0.25 |

Each of the alloys listed in Table 1 is deficient in that that it exhibits excessive wear and/or excessive cracking after a period of use under piercing conditions. Thus, piercer points fabricated from the alloys in Table 1 can only be used for a limited number of piercing runs before the point is unsuitable for further use and must be replaced. The limited service life of points made of the alloys in Table 1 is particularly evident when piercing relatively long billets, in which case a point is subjected to relatively high temperatures and for a relatively long time period.

The guide shoes of seamless tube fabricating apparatus are repeatedly rapidly heated to elevated temperature, and then rapidly cooled as the piercer point is quenched. Also, the guide shoes are contacted by the advancing spinning shell under an extreme stress load. Guide shoes are conventionally fabricated from certain iron-base and nickel-base alloys, including the conventional alloys listed in Table 2 below. The alloys in Table 2, identified in the table as F through H, are commonly referred to in the trade as "32-35", "E-14", and "CS-90" alloys, respectively.

TABLE 2

Conventional Alloy Compositions for Seamless Mill Guide Shoes

| Alloy | Ni | Cr | Mo | W | Fe | Mn | Si | C |
|---|---|---|---|---|---|---|---|---|
| F | 34.0-36.0 | 31.0-33.0 | 0.5 max. | 10.0 max. | Bal. | 0.60 max. | 1.00 max. | 0.10-1.00 |
| G | 11.0-13.0 | 24.0-26.0 | — | — | Bal. | 0.40-0.60 | 1.00 max. | 0.70-0.90 |
| H | 4.50-5.50 | 19.0-21.0 | — | — | Bal. | 0.60 max. | 0.30-0.70 | 0.90-1.10 |

Guide shoes cast from the alloys listed in Table 2 cannot withstand the thermal shock that results as the shoes are, over extended periods, subjected to repeated cycles of heating and cooling during piercing runs. As a result of this cyclic heating and cooling, thermal cracks can form on the surface of the guide shoes, and the shoes may fail. Also, certain of the conventional alloys from which guide shoes are fabricated, including the alloys listed in Table 2, have insufficient wear resistance and must be replaced often, necessitating additional cost and mill downtime.

Accordingly, it would be advantageous to provide alloys exhibiting improved performance and long service life when cast into piercer points and other seamless mill and hot working tools including, but not limited to, piercing mill guide shoes, rotary expander guide shoes, reeler guide shoes, and high-mill plugs. More generally, it would be advantageous to provide alloys exhibiting high strength at elevated temperatures and advantageous resistance to wear, oxidation, and thermal cracking in certain high-stress elevated temperature environments such as, for example, when applied in piercer points, guide shoes, and other mill tools used in the fabrication of seamless tubular products.

SUMMARY

According to one aspect of the present disclosure, a novel wear and oxidation resistant nickel-base alloy is provided that exhibits resistance to thermal cracking in high-stress elevated temperature environments, wherein the alloy comprises 53 to 67 nickel, 20 to 26 chromium, and 12 to 18 tungsten. Certain non-limiting embodiments of the alloy further comprise at least one of: 55 to 65 nickel; 22 to 25 chromium; 13 to 17 tungsten; up to 3 cobalt; up to 3 molybdenum; up to 6 iron; 0.1 to 0.5 manganese; 0.1 to 0.7 silicon; 0.1 to 0.6 aluminum; and less than 0.05 carbon. Certain other non-limiting embodiments of the alloy include at least one of: 53 to 67 nickel; 20 to 26 chromium; 12 to 18 tungsten; up to 1.5 cobalt; up to 1.5 molybdenum; up to 4 iron; 0.1 to 0.5 manganese; 0.20 to 0.60 silicon; 0.20 to 0.50 aluminum; and less than 0.05 carbon.

As used herein, a compositional range of an element that is "up to" some indicated value without reciting a lower limit value (for example, "up to 1.5 cobalt") includes the absence (0 weight percent) of the particular element. Also as used herein, a compositional range of an element that is "less than" some indicated value without reciting a lower limit value (for example, "less than 0.05 carbon") includes the absence (0 weight percent) of the particular element.

According to another aspect of the present disclosure, a novel wear and oxidation resistant nickel-base alloy is provided that exhibits resistance to thermal cracking in high-stress elevated temperature environments, wherein the alloy comprises: 53 to 67 nickel; 20 to 26 chromium; 12 to 18 tungsten; up to 3 cobalt; up to 3 molybdenum; up to 6 iron; 0.1 to 0.5 manganese; 0.1 to 0.7 silicon; 0.1 to 0.6 aluminum; and less than 0.05 carbon. Certain non-limiting embodiments of the alloy optionally further comprise boron and/or lanthanum, and the sum of the weight percentages of boron, lanthanum, and incidental impurities is no greater than 1.

According to yet another aspect of the present disclosure, a novel wear and oxidation resistant nickel-base alloy is provided that exhibits resistance to thermal cracking in high-stress elevated temperature environments, wherein the alloy comprises: 55 to 65 nickel; 22 to 25 chromium; 13 to 17 tungsten; up to 1.5 cobalt; up to 1.5 molybdenum; up to 4 iron; 0.1 to 0.5 manganese; 0.2 to 0.6 silicon; 0.2 to 0.5 aluminum; and less than 0.05 carbon. Certain non-limiting embodiments of the alloy optionally further comprise at least one of boron and lanthanum, and the of the weight percentages of boron, lanthanum, and incidental impurities is no greater than 1.

According to yet another aspect of the present disclosure, a novel wear and oxidation resistant nickel-base alloy is provided that exhibits resistance to thermal cracking in high-stress elevated temperature environments, wherein the alloy comprises: about 58 nickel; about 24 chromium; about 1.10 molybdenum; about 14.5 tungsten; about 0.58 iron; about 0.44 manganese; about 0.56 silicon; about 0.40 aluminum; and about 0.01 carbon.

According to a further aspect of the present disclosure, a novel wear and oxidation resistant nickel-base alloy is provided that exhibits resistance to thermal cracking in high-stress elevated temperature environments, wherein the alloy consists essentially of: 53 to 67 nickel; 20 to 26 chromium; 12 to 18 tungsten; optionally at least one of up to 3 cobalt, up to 3 molybdenum, up to 6 iron, 0.1 to 0.5 manganese, 0.1 to 0.7 silicon, 0.1 to 0.6 aluminum, less than 0.05 carbon, boron, and lanthanum; and incidental impurities. In certain non-limiting embodiments of the alloy, the sum of the weight percentages of boron, lanthanum, and incidental impurities is no greater than 1.

An additional aspect of the present disclosure is directed to a novel wear and oxidation resistant nickel-base alloy that exhibits resistance to thermal cracking in high-stress elevated temperature environments, wherein the alloy consists essentially of: 53 to 67 nickel; 20 to 26 chromium; 12 to 18 tungsten; up to 3 cobalt; up to 3 molybdenum; up to 6 iron; 0.1 to 0.5 manganese; 0.1 to 0.7 silicon; 0.1 to 0.6 aluminum; less than 0.05 carbon; optionally, at least one of boron and lanthanum; and incidental impurities.

Yet an additional aspect of the present disclosure is directed to a novel wear and oxidation resistant nickel-base alloy that exhibits resistance to thermal cracking in high-stress elevated temperature environments, wherein the alloy consists essentially of: 55 to 65 nickel; 22 to 25 chromium; 13 to 17 tungsten; optionally at least on of up to 1.5 cobalt, up to 1.5 molybdenum, up to 4 iron, 0.1 to 0.5 manganese, 0.2 to 0.6 silicon, 0.2 to 0.5 aluminum, boron, lanthanum, and less than 0.05 carbon; and incidental impurities. In certain non-limiting embodiments of the alloy, the sum of the weight percentages of boron, lanthanum, and incidental impurities is no greater than 1.

Yet a further aspect of the present disclosure is directed to a novel wear and oxidation resistant nickel-base alloy that exhibits resistance to thermal cracking in high-stress elevated temperature environments, wherein the alloy consists essentially of: 55 to 65 nickel; 22 to 25 chromium; 13 to 17 tungsten; up to 1.5 cobalt; up to 1.05 molybdenum; up to 4 iron; 0.1 to 0.5 manganese; 0.2 to 0.6 silicon; 0.2 to 0.5 aluminum; less than 0.05 carbon; optionally at least one of boron and lanthanum; and incidental impurities.

According to yet a further aspect of the present disclosure, a novel wear and oxidation resistant nickel-base alloy is provided that exhibits resistance to thermal cracking in high-stress elevated temperature environments, wherein the alloy consists essentially of: about 58 nickel; about 24 chromium; about 14.5 tungsten; about 0.44 manganese; about 0.56 silicon; about 0.40 aluminum; about 0.01 carbon; about 1.10 molybdenum; about 0.58 iron; optionally, at least one of cobalt, boron, and lanthanum, wherein the sum of the weight percentages of boron, lanthanum, and incidental impurities is no greater than 1.

Additional aspects of the present disclosure are directed to articles of manufacture including any of the alloys according to the present disclosure, including, but not limited to, those alloys referred to above. For example, one aspect of the present disclosure is directed to an article of manufacture comprising a wear and oxidation resistant nickel-base alloy exhibiting resistance to thermal cracking in high-stress elevated temperature environments, the alloy comprising: 53 to 67 nickel; 20 to 26 chromium; and 12 to 18 tungsten. In certain non-limiting embodiments of the article of manufacture, the alloy included in the article of manufacture comprises: up to 3 cobalt; up to 3 molybdenum; up to 6 iron; 0.1 to 0.5 manganese; 0.1 to 0.7 silicon; 0.1 to 0.6 aluminum; and less than 0.05 carbon. In certain non-limiting embodiments, the article of manufacture according to the present disclosure is a component of a seamless tube manufacturing apparatus. Non-limiting possible embodiments of the article of manufacture include: a seamless mill tool; a tool for one of a piercing mill, a high mill, and a rotary expander; a piercer point; a piercing mill guide shoe; a rotary expander guide shoe; a reeler guide shoe; and a high-mill plug.

According to yet an additional aspect of the present disclosure, a method of making a seamless tube or pipe is disclosed. The method comprises using an article of manufacture to make the seamless tube or pipe, wherein the article comprises at least one of the alloys according to the present disclosure, including, but not limited to, those alloys referred to above. In certain non-limiting embodiments, the article of manufacture according to the present disclosure is a component of a seamless tube manufacturing apparatus. Non-limiting possible embodiments of the article of manufacture that is used in the method include: a seamless mill tool; a tool for one of a piercing mill, a high mill, and a rotary expander; a piercer point; a piercing mill guide shoe; a rotary expander guide shoe; a reeler guide shoe; and a high-mill plug. According to one non-limiting embodiment of a method according to the present disclosure, the method comprises forming a hollow shell from a generally cylindrical alloy billet on a piercing mill including at least one component, such as a piercer point or a guide shoe, composed of a nickel-base alloy according to the present disclosure.

It is believed that embodiments of alloys according to the present disclosure will exhibit high elevated-temperature strength, substantial resistance to wear, oxidation, and thermal cracking, and long service life when formed into piercer points and other seamless mill and hot working tools and used in the production of seamless products such as tubing and pipe. These and other details and advantages of the subject matter according to the present disclosure will be apparent to those having ordinary skill upon considering the present disclosure. The reader also may comprehend additional details and advantages upon evaluating or using alloys, articles of manufacture, and methods within the present disclosure.

BRIEF DESCRIPTION OF THE DRAWINGS

The features and advantages of the alloys and articles described herein may be better understood by reference to the accompanying drawings in which.

DESCRIPTION OF CERTAIN NON-LIMITING EMBODIMENTS

Other than in the operating examples, or where otherwise indicated, all numbers expressing quantities of ingredients, processing conditions and the like used in the present description and claims are to be understood as being modified in all instances by the term "about". Accordingly, unless indicated to the contrary, any numerical parameters set forth in the following description and the attached claims are approximations that may vary depending upon the desired properties one seeks to obtain in the alloys and articles according to the present disclosure. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the present disclosure are approximations, the numerical values set forth in any specific examples herein are reported as precisely as possible. Any numerical values, however, inherently contain certain errors, such as, for example, equipment and/or operator errors, necessarily resulting from the standard deviation found in their respective testing measurements. Also, it should be understood that any numerical range recited herein is intended to include the range boundaries and all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Figure 1:
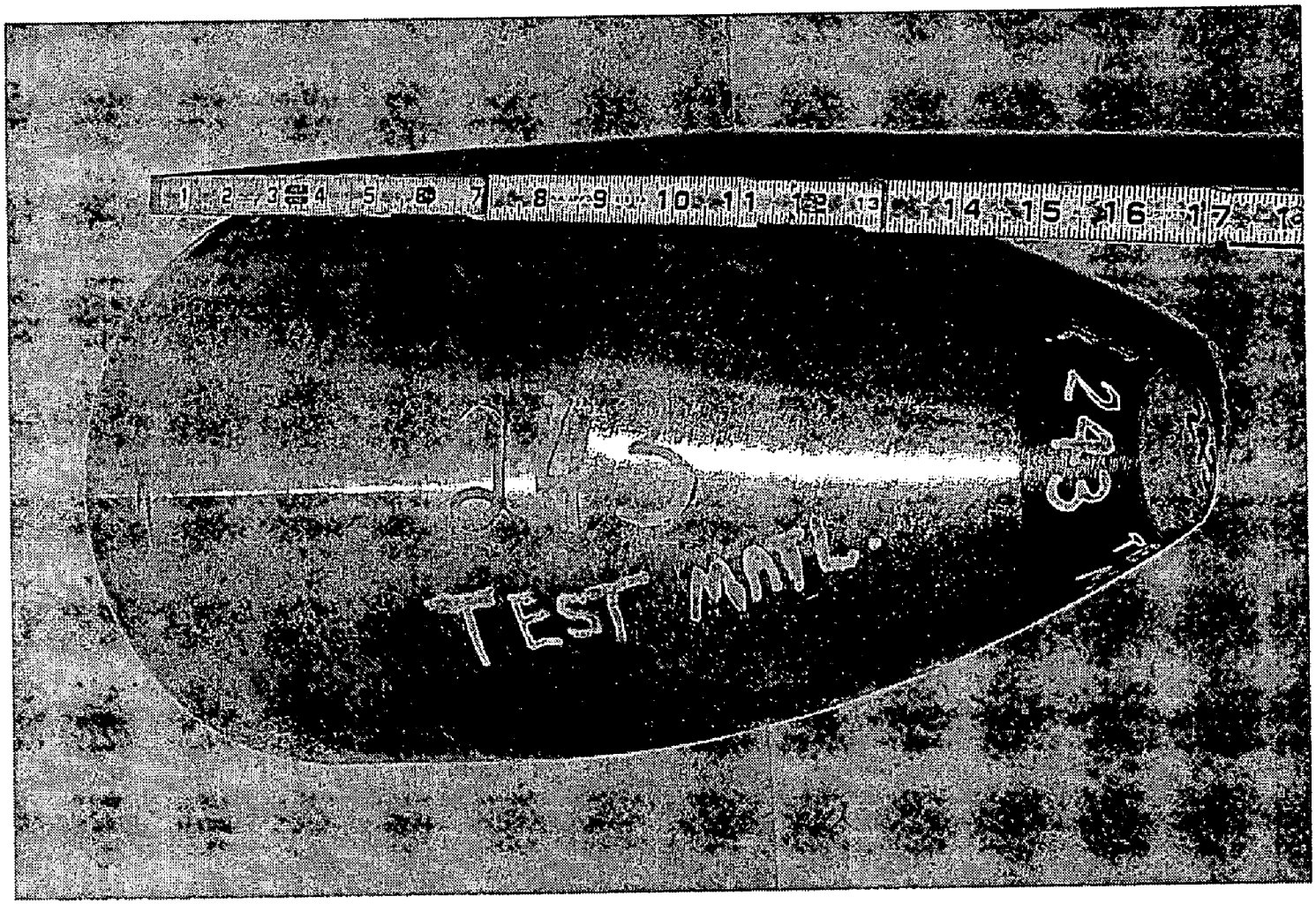
FIGS. 1 and 2 are photographs of a piercer point used in the tests described herein.
Figure 2:
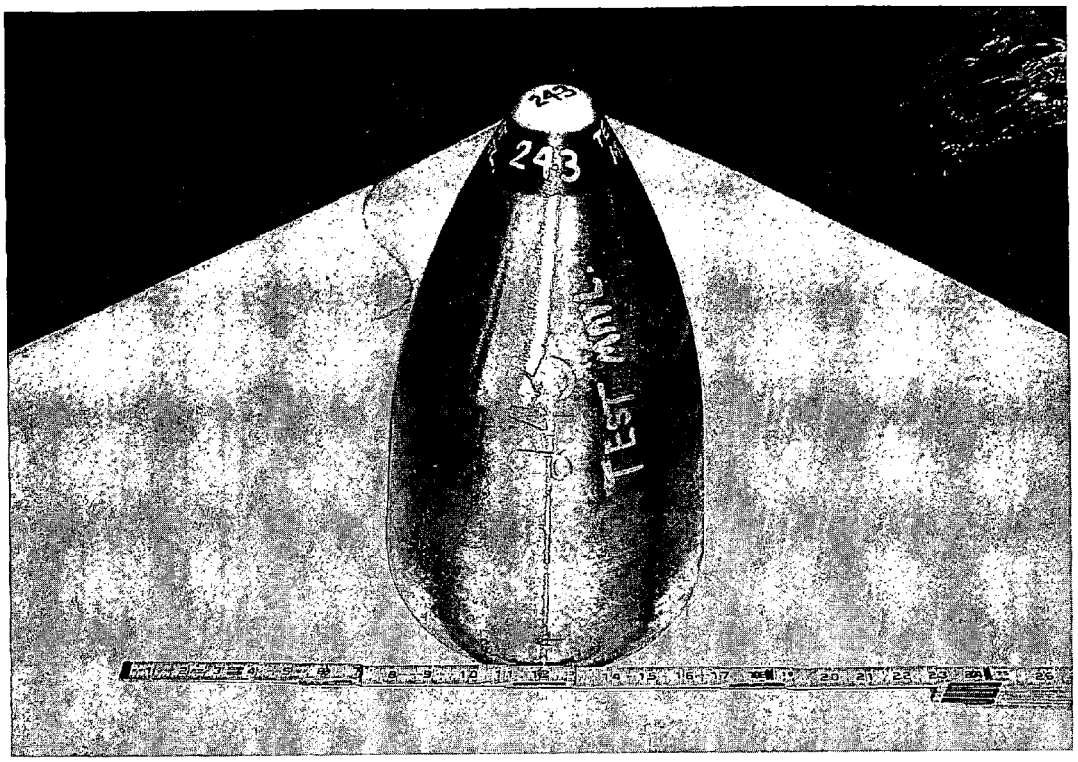

Investigations were undertaken to identify improved alloys useful as material from which may be formed mill tools for piercing mills, high mills, and rotary expanders used in the production of seamless tube and pipe products. Such tools include, for example, piercing points and guide shoes for piercing mills, rotary expander guide shoes, a reeler guide shoes, and high-mill plugs. To that end, an nickel-base alloy heat having the composition shown in Table 3 was prepared in an induction furnace by heating conventional starting materials including alumino thermic chrome (99.2% purity), tungsten bar (99.9% purity), electrolytic nickel (99.8% purity), and other alloying additions to about 3050° F. Piercer points having conventional dimensions and a largest diameter of 243 mm were fabricated from the heat in a conventional manner by pouring the molten material at about 2900° F. into sand molds made from silica sand and thermo-setting shell binder according to normal foundry practice. One such piercer point made in this way is shown in the photographs of FIGS. 1 and 2. Each piercer point fabricated in this manner was installed on a Vallourec-Mannesmann seamless pipe mill and evaluated for performance in piercing operations conducted on cylindrical billets of an alloy conventionally used in fabricating seamless tubing and pipes.

TABLE 3

| Ni | Co | Cr | Mo | W | Fe | Mn | Si | Al | C |
|---|---|---|---|---|---|---|---|---|---|
| 58.0 | — | 24.0 | 1.10 | 14.5 | 0.58 | 0.44 | 0.56 | 0.40 | 0.01 |

During the testing, 100 billets were successfully pierced in a conventional manner without any significant wear, shape loss, or cracking of the piercer points. In contrast, four piercer points made in an identical fashion but from Alloy B in Table 1 were used in a substantially identical piercing runs on the seamless pipe mill and developed thermal cracking and exhibited significant wear and shape loss, confirming the superior characteristics of the experimental alloy.

Accordingly, the tested alloy is a nickel-base alloy that includes chromium and tungsten and that exhibits excellent high-temperature strength and superior resistance to wear, oxidation, and thermal cracking during piercing operations. Based on the results, it would be expected that the alloy would show similar superior performance if used in the form of various other components and tools used in apparatus adapted for seamless tube manufacturing and hot working operations related to the manufacture of seamless products. For example, the components and tools may be for a seamless mill tool, such as, for example, a piercing mill, a high mill, or a rotary expander. In addition to piercer points, examples of components in which the alloy of the present disclosure may be used include piercing mill guide shoes, rotary expander guide shoes, reeler guide shoes, and high-mill plugs.

Based on the results of the testing conducted by the present inventors, the novel nickel-base alloy composition provided in Table 4 will provide excellent high-temperature strength and wear, oxidation, and thermal cracking resistance when fabricated into piercer points, guide shoes, plugs, and other tools used in piercing operations and other hot working operations related to seamless tube manufacturing and other operations related to the manufacture of seamless products. A more preferred composition of the alloy of Table 4 is shown in Table 5. It is believed based on the inventors' investigations, that piercer points, guide shoes, plugs, and other tools used in piercing operations and other hot working operations related to seamless tube manufacturing and other operations related to the manufacture of seamless products will enjoy a longer useful service life if made from the present alloys of Tables 4 and 5, relative to those components made from conventional alloys used for such purposes.

TABLE 4

| Ni | Co | Cr | Mo | W | Fe | Mn | Si | Al | C |
|---|---|---|---|---|---|---|---|---|---|
| 53.0-67.0 | 3.00 max. | 20.0-26.0 | 3.00 max. | 12.0-18.0 | 6.00 max. | 0.10-0.50 | 0.10-0.70 | 0.10-0.60 | less than 0.05 |

*Optionally boron, lanthanum and/or residual elements may be present up to about 1 weight percent in total.

TABLE 5

| Ni | Co | Cr | Mo | W | Fe | Mn | Si | Al | C |
|---|---|---|---|---|---|---|---|---|---|
| 55.0-65.0 | 1.50 max. | 22.0-25.0 | 1.50 max. | 13.0-17.0 | 4.00 max. | 0.10-0.50 | 0.20-0.60 | 0.20-0.50 | less than 0.05 |

*Optionally boron, lanthanum and/or residual elements may be present up to about 1 weight percent in total.

It is believed that chromium and tungsten in the amounts specified herein, as well as to some extent aluminum, impart high-temperature strength through solid solution strengthening of the austenitic nickel matrix. It also is believed that the alloy exhibits excellent ductility and ability to withstand thermal shock, essential requirements for hot working tools, due to the absence of any significant deleterious precipitated phases. It is further believed that the presence of chromium and aluminum also provide oxidation resistance and surface stability through the formation of protective oxides on the working surface of piercer points, as well as other articles that may be made from the present alloy. The oxide layer would act as a physical and thermal barrier between work surfaces of the articles and the surfaces of workpieces contacted by the articles, thereby inhibiting intermittent welding of the articles to the workpieces and localized overheating. For example, when piercer points are fashioned from the present alloys and used to fabricate hollow billets from which seamless tubing or piping is fashioned, the oxide layer forms on the surface of the piercer points and provides a physical and thermal barrier between the points and inner surfaces of cylindrical billets being pierced by the piercer points.

The foregoing description has necessarily presented a limited number of embodiments of the invention. Those of ordinary skill in the relevant art will appreciate that various changes in the compositions and other details of the examples that have been described and illustrated herein in order to explain the nature of the invention may be made by those skilled in the art, and all such modifications will remain within the principle and scope of the invention as expressed herein and in the appended claims. It will also be appreciated by those skilled in the art that changes could be made to the embodiments above without departing from the broad inventive concept thereof. It is understood, therefore, that this invention is not limited to the particular embodiments disclosed, but it is intended to cover modifications that are within the principle and scope of the invention, as defined by the claims.

We claim:

1. An article of manufacture comprising a wear and oxidation resistant nickel-base alloy exhibiting resistance to thermal cracking in high-stress elevated temperature environments, the alloy comprising, in weight percentages based on total alloy weight: 53 to 67 nickel; 20 to 26 chromium; 12 to 18 tungsten; up to 3 cobalt; up to 3 molybdenum; up to 6 iron; 0.1 to 0.5 manganese; 0.1 to 0.7 silicon; 0.1 to 0.6 aluminum; and up to 0.05 carbon, where the article of manufacture is one of a piercer point, a piercing mill guide shoe, a rotary expander guide shoe, a reeler guide shoe, and a high-mill plug.

2. The article of manufacture of claim 1, wherein the alloy comprises, in weight percentages based on total alloy weight, at least one of: 55 to 65 nickel; 22 to 25 chromium; and 13 to 17 tungsten.

3. The article of manufacture of claim 1, wherein the alloy comprises, in weight percentages based on total alloy weight:

55 to 65 nickel;
22 to 25 chromium;
13 to 17 tungsten;
up to 1.5 cobalt;
up to 1.5 molybdenum;
up to 4 iron;
0.1 to 0.5 manganese;
0.2 to 0.6 silicon;
0.2 to 0.5 aluminum; and
up to 0.05 carbon.

4. A method of making a seamless tube or pipe, the method comprising forming a hollow shell from a generally cylindrical alloy billet on a piercing mill including at least one article as set forth in claim 1.

5. The method of claim 4, wherein the article of manufacture is one of a piercer and a piercing mill guide shoe.

6. The article of manufacture of claim 1, further comprising at least one of boron, lanthanum, and residual impurities, wherein the sum of the weight percentages of boron, lanthanum, and residual impurities is no greater than 1.

7. The article of manufacture of claim 1, comprising, in weight percentages based on total alloy weight: about 58 nickel; about 24 chromium; about 1.10 molybdenum; about 14.5 tungsten; about 0.58 iron; about 0.44 manganese; about 0.56 silicon; about 0.40 aluminum; and about 0.01 carbon.

8. The article of manufacture of claim 1, wherein the alloy consists essentially of, in weight percentages based on total alloy weight:

53 to 67 nickel;
20 to 26 chromium;
12 to 18 tungsten;
up to 3 cobalt;
up to 3 molybdenum;
up to 6 iron;
0.1 to 0.5 manganese;
0.1 to 0.7 silicon;
0.1 to 0.6 aluminum;
up to 0.05 carbon;
incidental impurities; and
optionally at least one of boron and lanthanum, wherein the sum of the weight percentages of boron, lanthanum, and incidental impurities is no greater than 1.

9. The article of manufacture of claim 1, where the alloy consists essentially of, in weight percentages based on total alloy weight:

55 to 66 nickel;
22 to 25 chromium;
13 to 17 tungsten;
up to 1.5 cobalt;
up to 1.5 molybdenum;
up to 4 iron;
0.1 to 0.5 manganese;
0.2 to 0.6 silicon;
0.2 to 0.5 aluminum;
up to 0.05 carbon;
incidental impurities; and
optionally at least one of boron and lanthanum, wherein the sum of the weight percentages of boron, lanthanum, and incidental impurities is no greater than 1.

10. The article of manufacture of claim 1, consisting of, in weight percentages based on total alloy weight:

53 to 67 nickel;
20 to 26 chromium;
12 to 18 tungsten;
up to 3 cobalt;
up to 3 molybdenum;
up to 6 iron;
0.1 to 0.5 manganese;
0.1 to 0.7 silicon;
0.1 to 0.6 aluminum;
up to 0.05 carbon;
incidental impurities; and
optionally at least one of boron and lanthanum, wherein the sum of the weight percentages of boron, lanthanum, and incidental impurities is no greater than 1.

11. The article of manufacture of claim 1, wherein the alloy consists of, in weight percentages based on total alloy weight:

55 to 66 nickel;
22 to 25 chromium;
13 to 17 tungsten;
up to 1.5 cobalt;
up to 1.5 molybdenum;
up to 4 iron;
0.1 to 0.5 manganese;
0.2 to 0.6 silicon;
0.2 to 0.5 aluminum;
up to 0.05 carbon;
incidental impurities; and
optionally at least one of boron and lanthanum, wherein the sum of the weight percentages of boron, lanthanum, and incidental impurities is no greater than 1.

* * * * *